US012509965B2

(12) United States Patent
Cochran

(10) Patent No.: US 12,509,965 B2
(45) Date of Patent: Dec. 30, 2025

(54) ENERGIZED SWABBING DEVICE FOR A SLICKLINE BASED WELL INITIATION SERVICE TOOL

(71) Applicant: SAUDI ARABIAN OIL COMPANY, Dhahran (SA)

(72) Inventor: Jamie Cochran, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/672,627

(22) Filed: May 23, 2024

(65) Prior Publication Data

US 2025/0361796 A1 Nov. 27, 2025

(51) Int. Cl.
*E21B 37/10* (2006.01)
*E21B 34/02* (2006.01)

(52) U.S. Cl.
CPC ..... *E21B 37/10* (2013.01); *E21B 34/02* (2013.01)

(58) Field of Classification Search
CPC ..... E21B 37/10; E21B 21/14; E21B 37/06; B05D 7/225
See application file for complete search history.

(56) References Cited

U.S. PATENT DOCUMENTS 1,156,657 A 10/1915 Beam
1,883,053 A 10/1932 Standlee
2,609,258 A 9/1952 Taylor et al.
3,750,753 A * 8/1973 Bernard ..... E21B 43/13 166/309
4,498,536 A 2/1985 Ross et al.
5,795,402 A * 8/1998 Hargett, Sr. ..... B08B 9/0553 134/22.12
7,225,878 B2 6/2007 Holcomb et al.
7,354,483 B2 * 4/2008 Farris ..... B08B 9/0557 134/22.12
8,904,858 B2 12/2014 Pope et al.
9,828,815 B2 * 11/2017 Silveira ..... C09K 8/94
10,018,015 B2 7/2018 Purkis et al.
10,987,707 B2 4/2021 Saltykov et al.
(Continued)

FOREIGN PATENT DOCUMENTS

CN 202249942 U 5/2012
WO 2004057152 A1 7/2004
(Continued)

*Primary Examiner* — Cathleen R Hutchins
(74) *Attorney, Agent, or Firm* — Osha Bergman Watanabe & Burton LLP

(57) ABSTRACT

A bottom hole assembly (BHA) deployable in a production tubing includes a foam assembly and a swab assembly. The foam assembly includes a check valve unit coupled to a chemical canister. The swab assembly is coupled to the foam assembly. The swab assembly includes a swab mandrel and a plurality of swab cups. A method for initiating natural flow in a well includes conveying a bottom hole assembly (BHA) on a slickline to a first depth into a production tubing, holding the BHA stationary in the static fluid, releasing a foaming chemical from the chemical canister to the production tubing via the check valve unit, activating the foaming chemical to form a foam, opening a well flowline, and swabbing at least a portion of the production tubing with the swabbing assembly of the BHA by at least partially removing the BHA from the production tubing.

18 Claims, 6 Drawing Sheets

(56) References Cited

U.S. PATENT DOCUMENTS

| | | | | |
|---|---|---|---|---|
| 2014/0352965 | A1* | 12/2014 | Baker | E21B 41/02<br>166/244.1 |
| 2023/0004537 | A1 | 1/2023 | Oberhofer et al. | |
| 2023/0114329 | A1 | 4/2023 | Albeshri et al. | |

FOREIGN PATENT DOCUMENTS

| | | | |
|---|---|---|---|
| WO | 2008073343 | A1 | 6/2008 |
| WO | 2021072433 | A1 | 4/2021 |
| WO | 2021199000 | A1 | 10/2021 |

* cited by examiner

ENERGIZED SWABBING DEVICE FOR A SLICKLINE BASED WELL INITIATION SERVICE TOOL

BACKGROUND

In hydrocarbon well development, it is common practice to use electrical submersible pumping systems (ESPs) as a primary form of artificial lift. ESP operations may require unloading for initiating natural production flow on wells that have been killed with a workover fluid. The unloading process includes removing the column of kill fluid from the well. Unloading is commonly performed using coiled tubing to circulate nitrogen into the well at a deep injection point to induce flow by lightening the fluid column. An alternative method for unloading includes using a slimline through-tubing ESP with less surface equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a bottom hole assembly (BHA) deployable in a production tubing that includes a foam assembly and a swab assembly. The foam assembly includes a check valve unit coupled to a chemical canister, wherein the check valve unit comprises a plurality of foam nozzles. The swab assembly is coupled to the foam assembly. The swab assembly includes a swab mandrel and a plurality of swab cups.

In another aspect, embodiments disclosed herein relate to a method for initiating natural flow in a well. The method includes conveying a bottom hole assembly (BHA) on a slickline to a first depth into a production tubing, holding the BHA stationary in the static fluid, releasing a foaming chemical from the chemical canister to the production tubing via the check valve unit, activating the foaming chemical to form a foam, opening a well flowline, and swabbing at least a portion of the production tubing with the swabbing assembly of the BHA by at least partially removing the BHA from the production tubing. The production tubing includes a static fluid. The BHA includes a foam assembly and a swab assembly. The foam assembly includes a check valve unit coupled to a chemical canister, and the check valve unit includes a plurality of foam nozzles. The swab assembly is coupled to the foam assembly. The swab assembly includes a swab mandrel and a plurality of swab cups.

Other aspects and advantages of the claimed subject matter will be apparent from the following description and the appended claims.

DETAILED DESCRIPTION

Figure 1:
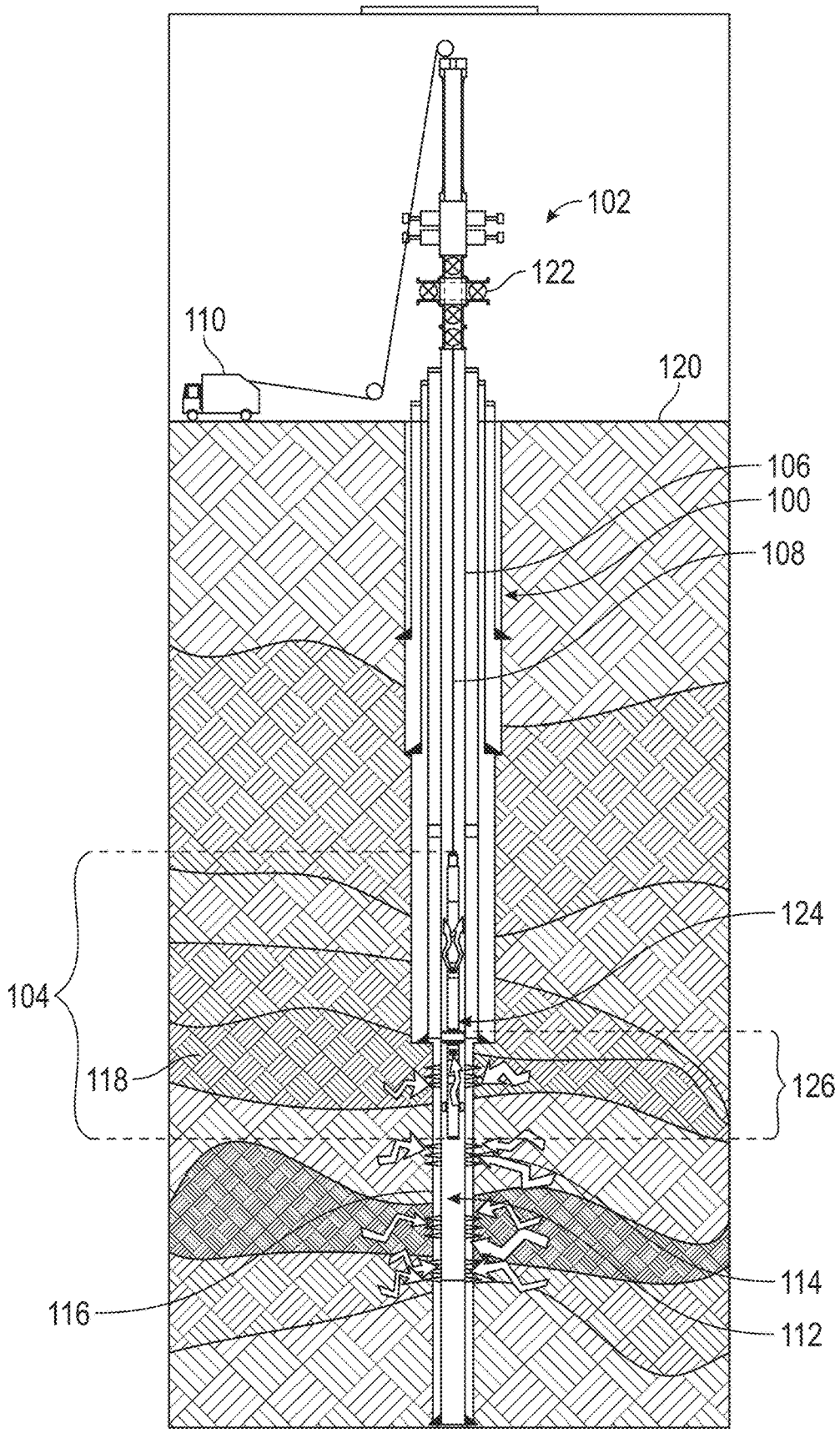
FIG. 1 shows an exemplary well with a well initiation system in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

As used herein, the term "coupled" or "coupled to" or "connected" or "connected to" may indicate establishing either a direct or indirect connection, and is not limited to either unless expressly referenced as such. Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Coiled tubing nitrogen pumping is time consuming and requires complex logics. The challenges of the existing slimline through-tubing ESP systems include setting and unsetting the packer system multiple times. Setting a packer with wireline in a wellbore is typically achieved using a setting tool for setting slips and a sealing element concurrently. The setting tools are single use items that require redress at surface. A redress requires tripping the setting tool out of the hole. Tripping the setting tool out of hole results in a reduction of operation efficiency. Furthermore, large temperature changes commonly experienced in unloading jobs are outside of the working range of the ESP system. Significant amounts of solids debris and different fluid viscosities are expected to flow through the ESP over the operation duration. Unloading operations have not been available in high hydrogen sulfide ($H_2S$) wells due to high current requirements, which can cause significant operational challenges with electronic initiation systems.

A slickline generally offers an inexpensive, rapid, and readily available system and method to perform well intervention. However, there are several challenges associated with the use of slicklines. For example, swabbing with a slickline is limited by line tension capacity. With larger tubing capacities, the slickline-swabbing system cannot remove enough volume during each run in hole to be a sufficient option for well unloading as attempting to swab too much fluid of the fluid column out of the well in one run is likely to snap the slickline from overwhelming tension on the slickline. Traditionally, larger and/or stronger braided cables are used for swabbing applications; however, these specialist units are not universally available.

Traditionally, foam and gas assisted lift systems can be used in a well. However, major drawbacks of such systems include expending or reaction once they are dropped into a well and hit the fluid level, dropping to the bottom of the well if the system is denser than well fluid, or both. In either scenario, this may not generate a foam column effective enough to expand and lift to the wellhead.

One or more embodiments disclosed herein may address and/or overcome the challenges of well unloading with slicklines. One or more embodiments disclosed herein relate to a bottom hole assembly connected to a slickline. The bottom hole assembly may include a swabbing assembly and a foaming assembly. In one aspect, embodiments disclosed herein relate to a well initiation system with a bottom hole assembly (BHA) that is connected to a slickline unit. The BHA may be configured to bleed off well head pressure and reduce flowline pressure. The BHA may promote the flow of fluids from an isolated intake port to an outlet port for the purpose of initiating or logging natural flow in a subterranean well. Specifically, one or more embodiments relate to a tool that includes foaming units and swabbing units integrated within a BHA connected to a slickline unit. The BHA including the combined slickline swabbing assembly and the chemical foaming assembly may be provided in a well or a wellbore to create a lift effect. Furthermore, embodiments disclosed herein may provide a system and method for unloading a well.

A well that has undergone a well kill with workover fluid includes a column of heavy fluid that prevents reservoir fluid from flowing through the hydrostatic head created by the fluid column suppressing the pressure of the reservoir fluids. In order to re-initiate natural flow in a well that has undergone a well kill, a well initiation system in accordance with one or more embodiments disclosed herein displaces the workover fluid column and reduces the hydrostatic pressure, thereby unloading the well. The BHA of one or more embodiments is configured to promote initiation of natural flow with the combined generation of a foam and well swabbing. Natural flow occurs when reservoir fluid is capable of flowing without the assistance of artificial lift.

To initiate natural flow in a well, a well initiation system including a BHA in accordance with embodiments disclosed herein is run through the production tubing to a depth of interest on a tool string. The well initiation system in accordance with one or more embodiments disclosed herein may be a modular combination of components including a foam assembly section and a swab assembly section. Operation of the swab assembly and the foam assembly may promote the displacement and removal of fluids from a production tubing. In turn, this removal decreases hydrostatic pressure on the formation and in the well, which can promote fluid flow downhole to the well surface. The foam assembly may be configured to promote the formation of a foam downhole when the BHA is placed in fluid, such that the fluid released from the BHA is in the form of a foam. In some embodiments, the fluid released from the BHA is capable of forming a foam column that extends to a wellhead. The released fluid may be configured to form a foam that can produce a lift effect to reduce tension on a slickline cable for well swabbing operations.

In accordance with embodiments disclosed herein, the swab assembly is operated to draw fluid from the formation into the well. During operation, the swab assembly of the well initiation service tool promotes the flow of fluid from the formation to surface. The foam assembly of one or more embodiments is configured to release foaming chemicals downhole from the BHA. The swabbing, the generation of the foam, or both lifts a dense fluid column (e.g., a static fluid, such as a kill fluid) out of the wellbore, which is then replaced by an influx of a less dense fluid from the formation.

The BHA may be moved or adjusted to other depths of interest in the well for continuation of foaming and swabbing operations. For horizontal well access, conveyance of slickline tools, such as the BHA, may be achieved by additional tractor modules in the tool string. Horizontal well access is possible in up to 90-degree well deviations with easily integrated tractor modules. In some embodiments, in high $H_2S$ wells, an existing $H_2S$ compliant slickline cable is available to be used.

FIG. 1 shows an exemplary well (100) with a well initiation service tool (102) in accordance with one or more embodiments. The well initiation service tool (102) includes a bottom hole assembly (BHA) (104) that is conveyed into production tubing (106) in the well (100) with a slickline cable (108) controlled by a slickline winch unit (110). The well initiation service tool (102) is used to help produce fluids (112) from a formation (118). The well (100) may include perforations (114) in the casing string (116) and/or production tubing (106) to provide a conduit for fluids (112) to enter the well (100) from the formation (118) and into the production tubing (106). The BHA (104) is deployed inside the production tubing (106) of the well (100). The production tubing (106) extends to the surface (120) and is made of a plurality of tubulars connected together to provide a conduit for fluids (112) to migrate to the surface (120). The surface (120) is any location outside of the well (100), such as the Earth's surface. Once the fluids (112) are produced to the surface (120), the fluids (112) flow through a wellhead (122). The fluids (112) may then flow into any production line or transportation, such as a pipeline or a tank.

Figure 2:
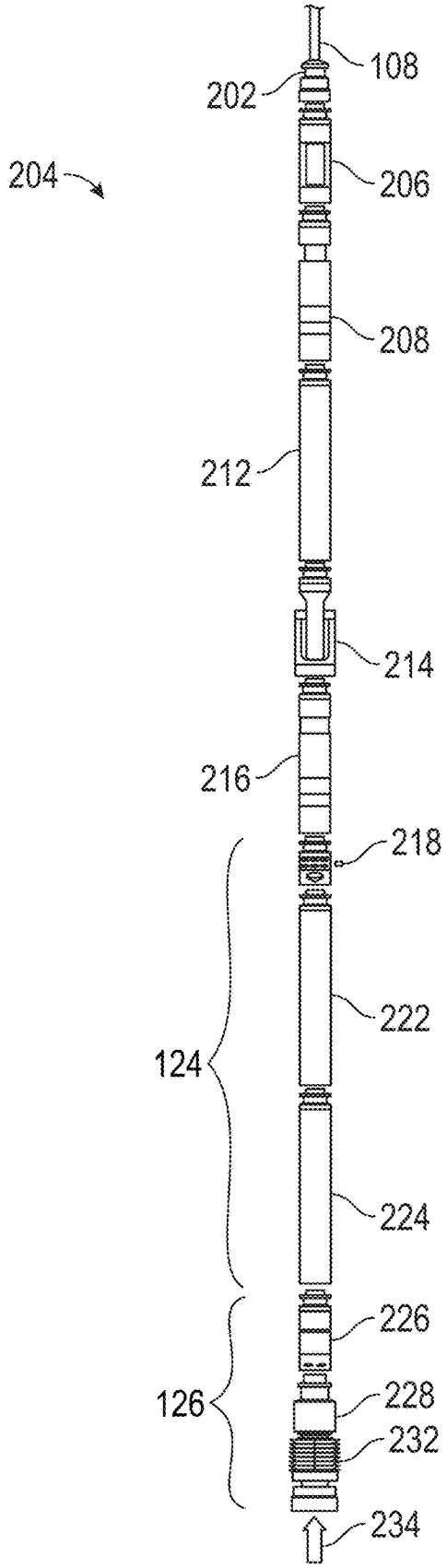
FIG. 2 shows a well initiation service tool in accordance with one or more embodiments.

The BHA (104) includes a foam assembly (124), a swab assembly (126), and one or more additional components as discussed in further detail in FIG. 2. The BHA (104) may also include various pipe segments of different lengths to connect the components of the BHA (104). The well initiation service tool (102) uses a swab assembly (126) integrated with the foam assembly (124) in the BHA (104), and which may be provided with enhanced temperature range, increased safety, and availability for use even in high $H_2S$ conditions.

As shown in FIG. 1, the swab assembly (126) may be attached below the foam assembly (124) such that swab assembly (126) is at a greater depth than foam assembly (124) when in a wellbore. In such instances, swab assembly (126) can force well fluid through a foaming agent chamber (not shown) of the foam assembly (124) while pulling the BHA (104) out of hole. In one or more embodiments, the BHA includes a swab assembly attached above a foam assembly such that the foam assembly is at a greater depth than the swab assembly when in a wellbore. For example, the swab assembly may be attached above a foam assembly and may force well fluid through the foam chamber of the foam assembly when running the BHA in hole. Operational conditions of the wellbore may dictate which BHA configuration is used.

FIG. 2 shows a well initiation service tool (102) including a bottom hole assembly (BHA) (204) in accordance with one or more embodiments. The BHA (204) may be conveyed to a predetermined depth in the production tubing (106). The production tubing (106) may include a static fluid at the predetermined depth such that the BHA (204) is disposed in the static fluid. The BHA (204) may be conveyed to the predetermined depth of the production tubing (106) by a system (e.g., a slickline unit) that includes a winch drum and mechanism, such as the slickline winch unit (110) and slickline cable (108) described in FIG. 1. The BHA (204) of FIG. 2 includes an integrated system that includes a swab assembly (126) and a foam assembly (124). The well initiation service tool can be utilized for displacing a heavy kill fluid column to be replaced by an influx of a lighter density fluid, such as produced fluid (112), from the reservoir or formation (118). The BHA (204) includes multiple components, such as the foam assembly (124), the swab assembly (126), a rope socket (202), and one or more additional tool string components. The rope socket (202) may be coupled to the slickline cable (108) of the slickline unit. The slickline cable (108) may be a size suitable for running tools in a production tubing. For example, the slickline may have an outer diameter of 0.1875 inches (or 3/16").

As shown in FIG. 2, the foam assembly (124) may be coupled between the rope socket (202) and the swab assembly on BHA (204). The foam assembly (124) includes at least one chemical canister (222, 224), and a check valve unit (218). The check valve unit (218) includes a plurality of nozzles. The check valve unit (218) is configured to release one or more foaming chemicals from the at least one chemical canister into the production tubing. The at least one chemical canister may be a suitable size to store and transport one or more chemicals to a downhole location. For example, the at least one chemical canister may be between 10 inches to 20 inches in length. The one or more foaming chemicals are configured to produce a foam in a downhole location of a wellbore upon activation.

The foam assembly may be configured to release the foaming chemical in an amount sufficient to form a column of foam in the production tubing, wherein the column of foam has a length from a target depth to a wellhead and flowline. The foam assembly may be configured to store one or more foaming chemicals such that the foaming chemical is conveyed from a surface location to a target depth in the production tubing. The foaming chemical may be stored in the foam assembly in a sufficient amount to provide a column of foam in the production tubing from the target depth to a wellhead and flowline. The foam may be generated in the presence of a fluid (e.g., a static fluid that occupies the production tubing at the target depth). In some embodiments, the foam generated from the foaming chemical is configured to form a foam at a target depth of a well and lift a target volume of a static fluid that occupies the production tubing at the target depth of the well. In one or more particular embodiments, the generated foam is configured to provide sufficient lift of the BHA, the static fluid, or both such that at least a portion of the tension of the slickline is alleviated.

The foam assembly may include at least one chemical canister coupled between the check valve unit (218) and the swab assembly (126). In some embodiments, the foam assembly includes at least two chemical canisters (e.g., a first chemical canister (222) and a second chemical canister (224)), which may be coupled in series between the check valve unit (218) and a safety bypass sub (226) of the swab assembly (126).

The at least one chemical canister may store at least one foaming chemical. The foaming chemical may be a chemical that generates a foam. The foaming chemical may be released when the BHA (204) is conveyed to a downhole location in a production tubing such that a foam is generated downhole in the production tubing. The foam generated from the foaming chemical may create artificial lift when generated downhole during a well unloading run. Non-limiting examples of the foaming chemical may include one or more chemicals selected from the group consisting of a gas, a surfactant, oil, and water. Non-limiting examples of a gas may be one or a mixture of any two or more of carbon dioxide, nitrogen, air, methane, ethane, propane, butane or hydrogen sulfide.

The water may be distilled water, deionized water, tap water, fresh water from surface or subsurface sources, production water, formation water, natural and synthetic brines, brackish water, natural and synthetic sea water, black water, brown water, gray water, blue water, potable water, non-potable water, other waters, and combinations thereof, that are suitable for use in a wellbore environment. In one or more embodiments, the water used may naturally contain contaminants, such as salts, ions, minerals, organics, and combinations thereof, as long as the contaminants do not interfere with the formation of a foam column.

The surfactant may be a foam-producing surfactant. The foaming chemical may include an anionic, a nonionic, or an amphoteric surfactant with foam-producing characteristics. Anionic surfactants are those which ionize in aqueous solutions to form positively charged components, with the surface active portion being negatively charged. The surface active portion is typically a sulfate, sulfonate, carboxylate or phosphate. One class of anionic surfactants with strong foam-producing characteristics is the ammonium or sodium salts of ethoxylated sulfated alcohols, sometimes described as a salt of ethoxylate sulfate.

Nonionic surfactants are those which have little or no tendency to ionize in aqueous solutions. The water soluble part of the molecule is attracted to water by means of a hydrogen bonding which is caused by the presence of atoms of a highly electronegative element such as oxygen. One class of nonionic surfactants, with strong foam-producing characteristics, is the linear alcohol ethoxylates which are the products of the reaction of a linear alcohol, such as decanol, with ethylene oxide.

Amphoteric surfactants are those whose molecules are characterized by two functional groups such as a positively charged amino group and a negatively charged carboxyl group. One class of amphoteric surfactants with strong foam-producing characteristics is the amido betaines.

Additionally, surfactant or foaming agent may comprise additives including ionic liquids and deep eutectic solvents, which can be hydrophilic, hydrophobic, and/or amphoteric/zwitterionic.

The foaming agent or surfactant may be selected for a particular static fluid composition or formation fluids because the foam-producing characteristics are influenced by the nature of reservoir rock, such as carbonate or sandstone, the properties of the reservoir, such as temperature and pressure, and composition of the reservoir fluids, such as salinity, divalent ion concentration, pH, etc.

Referring back to FIG. 2, the swab assembly (126) may be coupled after the foam assembly (124), such as at the end of the BHA (204). In some embodiments, the swab assembly is configured to swab the production tubing after a foam is formed in the production tubing. The swab assembly (126) may include a safety bypass sub (226) that is coupled between the foam assembly (124) and the swab mandrel (228). The safety bypass sub (226) may be configured to release tension in the slickline cable (108). The swab assembly may include a swab mandrel (228) that includes a plurality of swab cups (232). The swab cups may be coupled in series on the swab mandrel. The swab cups may be configured to drag or carry fluid from a downhole location to an uphole location (e.g., a wellhead). The swab cups may have a diameter smaller than the size of the tubing. For example, the swab cups may have a diameter of approximately 4 inches for a production tubing having an inner diameter size of 4.5 inches.

In some embodiments, the swab mandrel (228) is a spring-loaded mandrel configured to unload differential pressure from outside of the BHA to the inside of the BHA. For example, a first end of the spring-loaded mandrel may be coupled to the slickline cable, a component of the BHA, or both via a rope socket. In one or more embodiments, the first end of the spring-loaded mandrel is rigidly coupled to the slickline cable, a component of the BHA, or both. The spring-loaded mandrel may be hollow. The spring-loaded mandrel may extend from the BHA to below swab cups (232). A second end of the spring-loaded mandrel may be coupled to swab cups (232). The spring-loaded mandrel may be in fluid communication with swab cups (232).

The swab assembly (126), the BHA (204), or both may swab the production tubing once a foam is generated. The generated foam may produce an artificial lift of fluids in the production tubing, which may relieve tension of the slickline cable connected to the BHA (204) to assist in swabbing the production tubing. In effect, the BHA (204) is configured to promote fluid flow of static fluid from the downhole location to the surface of the well (as indicated by arrow (234)) without adding overwhelming tension on the slickline cable (108).

One or more components of the BHA (204) may be configured to generate an axial load when pulling the BHA tool out of hole. Swab cups (232) may be configured to generate an axial load on the slickline cable and the BHA (204) when pulling BHA (204) out of hole. For example, as the BHA (204) assembly is pulled out of hole, the swab cups (232) may be configured to generate an axial load. The generated axial load may be a combination of weight of well-bore fluid above, the BHA (204), the slickline cable, and friction.

One or more components of the BHA (204) may be configured to reduce the force load on the cable such that the load on the cable does not exceed a safe working load rating and prevents cable breakage. The axial load may be at least partially distributed to a spring of a mandrel shoulder. The axial load at least partially distributed to the spring may compress or extend the spring, causing a change in relative length of the spring. This relative change in spring length may open a flow port (e.g., by unseating a check valve ball). The relative change in spring length may enable fluid to flow from the tool, such as via a tubing annulus above the swab cup to below the tool by creating a diverted flow path through seals of the swab cups (232).

Once sufficient excess fluid (e.g., excess fluid causing excessive force with swab cups (232) as compared to the original cable and BHA load) has been diverted from above (i.e., an uphole location) the swap cups (232) to below (i.e., a downhole location), such that the axial load is reduced or removed, the force reaction against the spring of the spring-loaded mandrel will decrease. The spring may be configured to revert to its original shape once the force reaction against the spring is reduced or removed. The length of the spring may change such that the flow port may close (e.g., via the re-seating of a ball in a ball check valve), which at least partially reduces flow of fluid from above the cups to below.

However, in some instances, the tension of the slickline cable (108) may exceed the line limit. When this occurs, the safety bypass sub (226) may be opened such that fluid may flow through the safety bypass sub (226) and tension of the slickline cable (108) may be relieved.

As shown in FIG. 2, the BHA (104) may include numerous additional components, such as a memory sensor package (206), a slickline cable (108), a release joint (216), an anti-blow out sub (208), a stem bar (212), and a spang jar (214), among other components. The memory sensor package (206) may record measurements when the BHA (204) is conveyed to a downhole location. For example, the memory sensor package (206) may be configured to record a temperature of one or more fluids, a pressure of one or more fluids, or both when the BHA (204) is conveyed to a downhole location for well unloading. The memory sensor package (206) may be coupled between the rope socket (202) and an anti-blowout sub (208). The anti-blow out sub (208) may be coupled between the memory sensor package (206) and the stem bar (212). The anti-blowout sub (208) may be a tool string component that prevents a sudden or unexpected flow of fluid from the well to the surface.

Figure 3A:
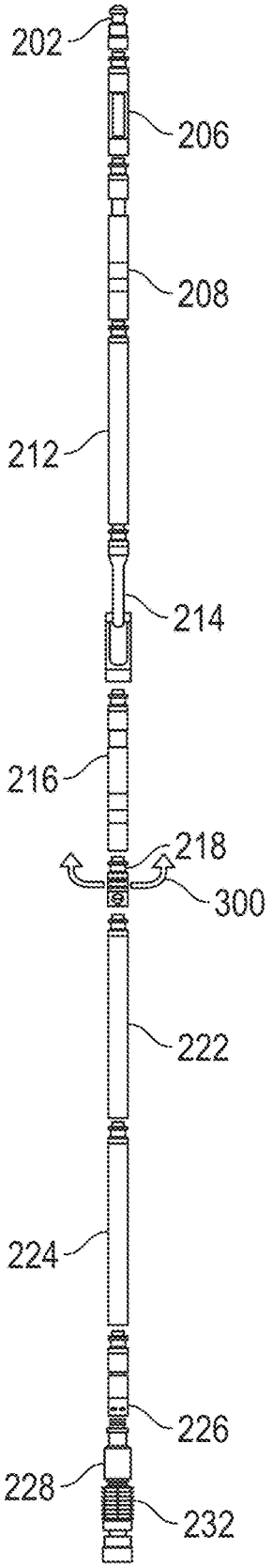
FIGS. 3A-3D show a well initiation service tool in different states of operation in accordance with one or more embodiments.
Figure 3B:
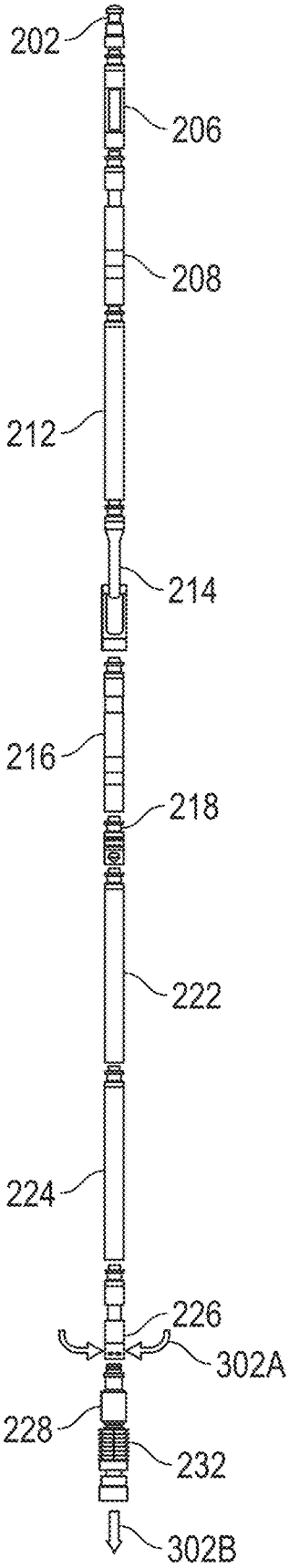

A stem bar (212) is a weighted bar that is included in the well initiation system to circumvent wellhead pressure and friction where the slickline enters the wellbore at the surface. The stem bar (212) of the BHA (204) may be coupled between the anti-blowout sub and the spang jar (214). The stem bar (212) may include one or more selected from steel, lead, tungsten or mercury alloys, and combinations thereof. The spang jar (214) is configured to expand once swabbing operations are initiated. For example, the spang jar (214) may be configured to expand as shown in FIG. 3A once the BHA (204) is pulled out of hole. In FIG. 3A, the direction of fluid flow may be as indicated by arrows 300. If the well initiation service tool including the BHA (204) and slickline cable experiences overpull when pulling the BHA out of hole, the fluid flow may reverse (represented by arrow 302A and 302B) as shown in FIG. 3B. The spang jar (214) may be a tool that generates an impact force to the BHA (204) downhole, which may be in conjunction with the weight of the stem bar (212) above the jar, the movement speed, and the speed of the wireline. The spang jar may have a size in the range of 2 to 3 inches in outer diameter. In one or more particular embodiments, the spang jar has an outer diameter of about 2.5 inches.

Referring back to FIG. 2, the spang jar (214) may be coupled between the stem bar (212) and a release joint (216). The release joint (216) may be a tool that is designed to part into sections under specified conditions such that a portion of the BHA (104) is left behind in the wellbore as the slickline cable connected to the remaining portion of the BHA (104) is retrieved. The release joint (216) may be coupled between the spang jar (214) and the foam assembly (124).

Figure 3C:
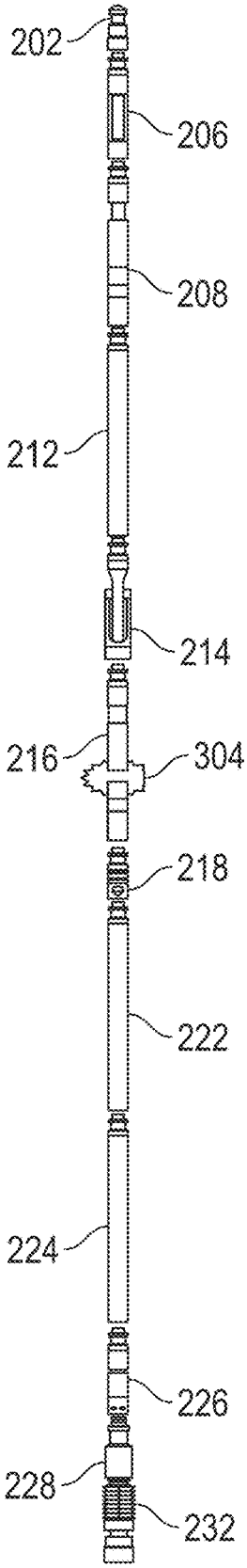

The BHA (e.g., 104 or 204) may include an emergency component. The emergency component involves mechanisms to activate an emergency release protocol or signal at a predetermined threshold pressure value based on the differential pressure in the wellbore, if the tension of the slickline exceeds the line limit, if the spang jar (214) has malfunctioned such that expansion is no longer possible, or if the tool is stuck. For example, when the spang jar (214) has malfunctioned or the tool is stuck, the BHA may include mechanisms and features to initiate a release protocol (represented by 304) to unset the release joint (216) as shown in FIG. 3C. This protocol initiation may promote release of the foam assembly (124) and the swab assembly (126).

Figure 3D:
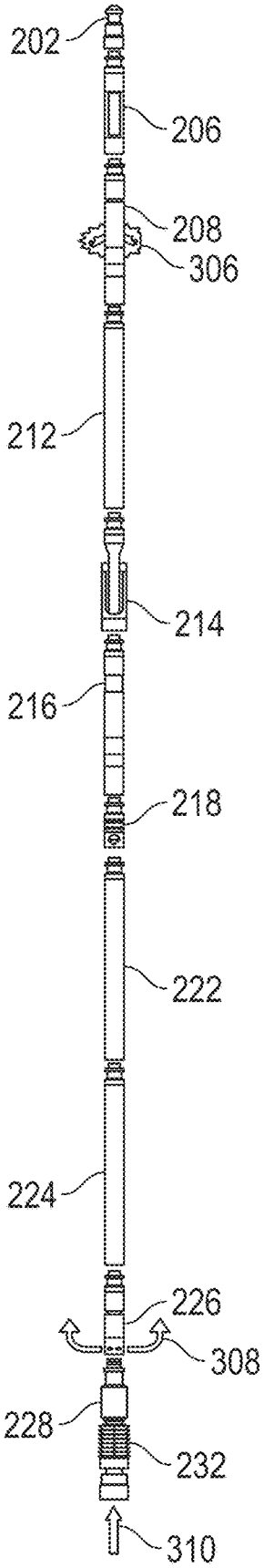

A well kick involves unpredictable and extreme pressure in the well (100) (represented by arrow 306 of FIG. 3D) that leads to fluids in the formation (118) to flow back up into the wellbore, which can generally lead to equipment damage if contingency features are not present. Contingency features embedded in the BHA may include mechanisms to absorb rapid fluid pressure emerging from below the BHA, such as in an anti-blowout sub, a spang jar (214) that may be configured to contract during a well kick as shown in FIG. 3D, or both. The anti-blowout sub may include one or more slips that spring out to grip the inside wall of the tubing in the event that tool weight and cable tension become neutral as the tool is being ejected out of the well. A non-limiting example of the anti-blowout sub include a Hunting PLC Anti Blow Up Tool. In one or more embodiments, BHA (204) includes a safety bypass sub (226) that is configured to prevent excessive force from building up underneath BHA (104) while in hole. Safety bypass sub (226) may be configured to enable well kick fluid to bypass swab cups (represented by arrows 308 and 310), thereby preventing excessive force from building up underneath BHA (104).

In one or more embodiments, the BHA (104), the well initiation system, or both includes a memory sensor package including one or more sensors. In such embodiments, the memory sensor package can be used for post-run or post-job analysis, future optimization, or any combination thereof. The memory sensor package of the BHA (104), the well initiation system, or both may be configured for real time data transmission to a computer located at a surface location of the formation. Memory sensor packages for real time data transmission may use radio frequency (RF) telemetry, embedded fiber optic components, or combinations thereof. Non-limiting examples of memory sensor packages for real time data transmission include a Slick E Line® system (Paradigm Technology Services, the Netherlands) or a Slick O Line® system (Paradigm Technology Services, the Netherlands).

The BHA (104) may include a memory sensor package that includes one or more sensors (not shown) disposed along the BHA, on the end of the BHA, or combinations thereof. The memory sensor package may include a memory temperature gauge, a memory pressure gauge, or both. The one or more sensors may be configured to measure operating data, such as pressure measurements, temperature measurements, and fluid flow measurements. The sensor may include but is not limited to a pressure sensor, density sensor, temperature sensor, gas volume fraction (GVF) sensor, flow sensor, tension sensor, etc. The sensor may measure and collect operating data in real time during operations. The one or more sensors may be configured to transmit data to a computer at a surface location, a computer at a laboratory location, or any combination thereof.

Figure 4:
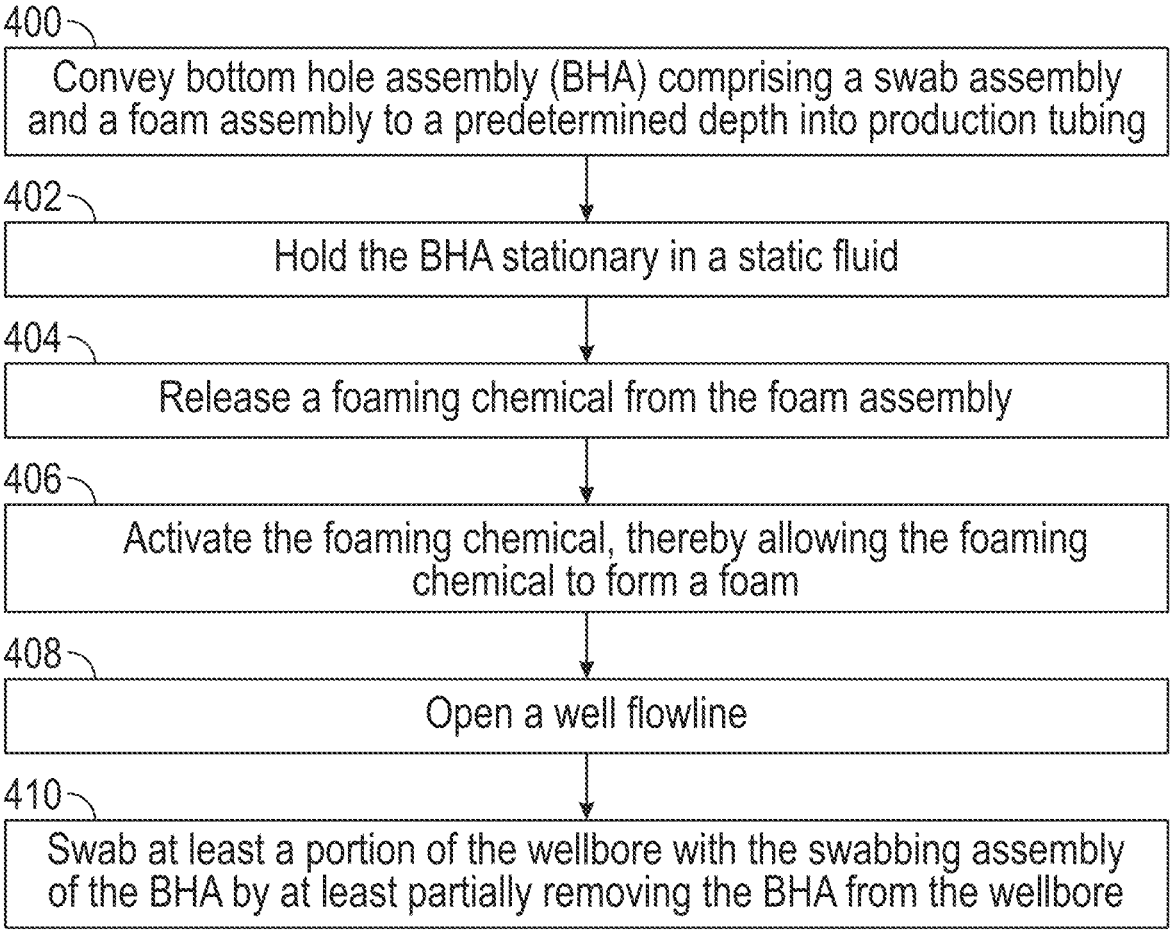
FIG. 4 shows a method flow chart in accordance with one or more embodiments.

FIG. 4 shows a flowchart of a method in accordance with one or more embodiments. Specifically, FIG. 4 describes a general method for initiating natural flow in a well in accordance with one or more embodiments. One or more blocks in FIG. 4 may be performed by one or more components (e.g., the BHA as described in FIGS. 1-2 and 3A-3D). While the various blocks in FIG. 4 are presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

Initially, in Block 400, a bottom hole assembly (BHA) includes a foam assembly that includes a check valve unit and at least one chemical canister. The BHA may include and a swab assembly that is coupled at the end of the foam assembly. The BHA may be conveyed to a predetermined depth of a production tubing. The BHA, the foam assembly, and the swab assembly may be as described in FIG. 1 or 2. In some embodiments, the foam assembly is coupled between a rope socket and the swab assembly. The swab assembly may be coupled to the end of the foam assembly. The BHA may be conveyed to a predetermined depth into production tubing of a well.

A slickline unit that includes a slickline winch may be positioned in front of the well as per common rig up practice. A slickline cable of the slickline unit may be coupled to the rope socket, such that the slickline unit is configured to convey the BHA to a first depth in the production tubing. The first depth may be a predetermined depth. In one or more embodiments, the depth at which the static fluid is present is identified by a sudden change in line tension while running the BHA in hole. Lower pressure control equipment may be rigged up onto a Christmas tree to control the flow produced by the well. The BHA is prepared, picked up, and installed into a slickline cable. Pressure control equipment may then be closed by making up the well. Pressure testing may be conducted to confirm integrity. The method may include bleeding off all well head pressure and reducing flowline pressure to a value as low as possible prior to conveying the BHA to a predetermined depth. The at least one chemical canister of the BHA may be loaded with a foaming chemical as described above. The loaded BHA may be loaded into a lubricator and connected to a wellhead. The well is opened, and the BHA is run through the production tubing on the slickline. At the first depth, the production tubing may include a static fluid. The static fluid may be a dense fluid column. For example, a production tubing may include about 500 feet of a fluid level proximate to a depth of interest.

In Block 402, the BHA is held stationary at the first predetermined depth in a tubing of the wellbore. At the first predetermined depth, a foaming chemical may be released from at least one chemical canister to the production tubing via the check valve unit in Block 404. The foaming chemical may be activated to form a foam as shown in Block 406. Activation of the foaming chemical may include increasing the temperature of the foaming chemical with the temperature of the formation, pressurizing the foaming chemical with the downhole pressure of the formation, releasing one or more additional foaming chemicals, or combinations thereof. As such, releasing the foaming chemical from the BHA at a predetermined depth or activating the foaming chemical released at the predetermined depth may allow for the formation of a foam.

In one or more embodiments, the BHA is configured to release the foaming chemical by controlling the time of exposure in the wellbore. In such embodiments, the amount of time the BHA is exposed to the wellbore is controlled by a running speed of a winch unit. Operational parameters, such as the running speed of the winch unit, the time of exposure of the BHA in a wellbore, the types of foaming chemicals used, among other parameters may be optimized based on the wellbore environment. In some embodiments, the operational parameters may be adapted after each BHA run in hole based on observational results.

In Block 408, a well flowline may be opened at the surface of the well to allow for downhole or uphole movement of the BHA. In Block 410, at least a portion of the production tubing may be swabbed with the swabbing assembly of the BHA. The swabbing of the BHA may be supported by the artificial lift generated from the foam such that undue tension is not experienced by a slickline cable of the well initiation system. Swabbing at least a portion of the production tubing may be performed by moving the BHA uphole from the predetermined depth of the tubing to the surface of the well. In some embodiments, swabbing the production tubing includes swabbing the wellbore to a surface of the wellbore. In such embodiments, the BHA may be retrieved from a wellhead at the surface of the well.

Retrieving the BHA may be performed by pulling the BHA (or a tool string including the BHA) into a lubricator and closing the swab valve of the wellhead. The closed well may be monitored to determine if the well is naturally flowing (e.g., if foam or fluid returns to the surface). If the well is determined to be naturally flowing, production processes may be initiated for the well.

If the well is not naturally flowing, pressure control equipment disposed at a wellhead of the well may be opened, and the BHA may be accessed where the BHA is lowered out of bottom. Swab cups may be checked and redressed as necessary. Data may be collected from the memory sensor package by a computer located at the surface of the well, a computer that is located off-site, or both.

A plan for a subsequent attempt (or an additional run) for unloading the well with the BHA may be determined or adjusted (e.g., volume and/or type of foaming chemical(s) may be chosen) based on the collected data. In some embodiments, the collected data is manually processed such that the actuation of a bypass valve of the BHA (e.g., a check valve of a check valve unit as described previously) is determined. In some embodiments, the collected data is processed with a computer such that the actuation of a bypass valve of the BHA (e.g., a check valve of a check valve unit as described previously) is determined. The weight of the fluid present downhole may be determined from the collected data. In some embodiments, a static fluid level is determined via processing of the collected data.

The actuation of the bypass valve may be determined from the collected data via analysis of a plot signature. Analysis of the plot signature may include determining a flat region of a line tension versus depth plot at a time when the tension was previously increasing. Based on this determination, adjustments may be made to the operational procedure. Adjusting the operational procedure may include removing relatively smaller portions of the fluid level present in the wellbore (e.g., reducing the run in hole depth of the BHA) in subsequent runs as compared to the initial run in which data was collected. Adjusting the operational procedure may include conveying the BHA to a depth greater than the first predetermined depth if a flat region of a line tension versus depth plot is absent. In one or more embodiments, a second depth of the production tubing is determined for one or more subsequent runs in hole with the BHA. The BHA may be conveyed to the second depth on a subsequent run. In some embodiments, collection of data and adjustment of run in hole depth is repeated to remove at least a portion of static fluid and regenerate fluid flow from the well.

A foaming chemical may be loaded in the at least one chemical canister of the BHA, and the BHA may be reloaded in the pressure control equipment of the wellhead. The conveyance of the BHA to a target depth, formation of foam, and swabbing the production tubing may then be repeated to initiate natural fluid flow in a well. In some embodiments, one or more blocks of the method of FIG. 4 can be repeated until natural fluid flow is initiated in the well.

Figure 5:
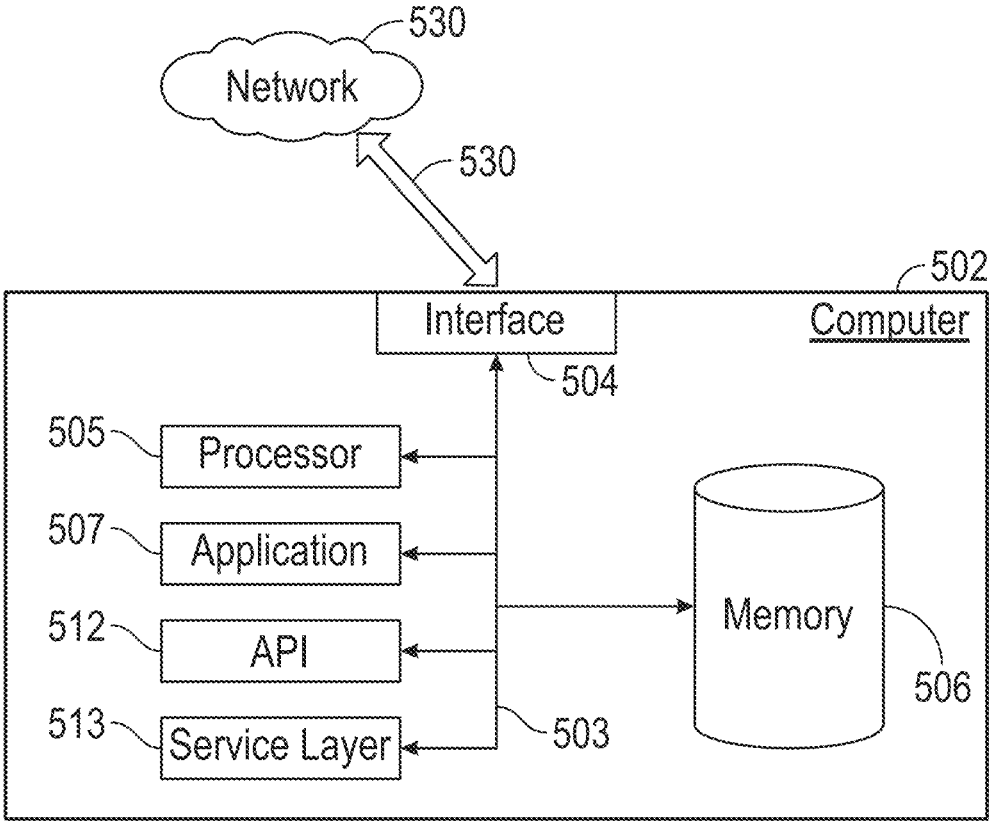
FIG. 5 shows a computer system in accordance with one or more embodiments.

Embodiments may be implemented using a computer system. For example, the data stored on a memory sensor package may be collectedtransmitted to a computer. In some embodiments, calculations for estimating the density value are performed on a computer of the control system. FIG. 5 is a block diagram of a computer system (502) used to provide computational functionalities associated with described algorithms, methods, functions, processes, flows, and procedures as described in the instant disclosure, according to an implementation. The illustrated computer (502) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environments (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 4, two or more interfaces (504) may be used according to particular needs, desires, or particular implementations of the computer (502). The interface (504) is used by the computer (502) for communicating with other systems in a distributed environment that are connected to the network (530). Generally, the interface (504 includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

Application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

In some embodiments, the computer (502) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

During conventional well unloading operations, challenges are encountered including solids debris obstructing pumps, high temperatures overloading downhole equipment, and lack of downhole data. The well initiation service tool (102) overcomes these challenges using a BHA that includes a foam assembly (124) and a swab assembly (126). The well initiation service tool (102) includes debris tolerant metal equipment, which may have larger operating temperature ranges than conventional operating temperature ranges. The well initiation service tool (102) operates foam generated by a foaming chemical released by the foam assembly (124) to create artificial lift of fluids in the production tubing, which may provide sufficient energy and artificial lift for the production tubing to be swabbed using the swab assembly (126) of the BHA (104) without increasing the tension on the slickline cable. The custom BHA including a spring-loaded mandrel of one or more embodiments unloads differential pressure across the BHA (e.g., outside to inside) should the slickline tension limit be exceeded. Additionally, by using a chemical canister, the reactive chemicals can be delivered to a zone of interest and generate a head of foam that is the of a desired and controllable length from the zone of interest to the wellhead and flowline.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A bottom hole assembly (BHA) deployable in a production tubing, the BHA comprising:

a foam assembly, the foam assembly comprising:

the foaming assembly is configured to release a foaming chemical to form a foam;

at least one chemical canister; and a check valve unit coupled to the at least one chemical canister, wherein the check valve unit comprises a plurality of foam nozzles; and a swab assembly coupled to the foam assembly, wherein the swab assembly comprises a swab mandrel and a plurality of swab cups; wherein the at least one chemical canister comprises a second chemical canister coupled between a first chemical canister and the swab assembly; and wherein the BHA is configured to displace a workover fluid and reduce hydrostatic pressure in the production tubing with a combined generation of the foam from the foam assembly and well swabbing with the swab assembly.

2. The BHA of claim 1, further comprising a rope socket coupled to a slickline unit.

3. The BHA of claim 2, further comprising one or more selected from spang jar, a stem weight bar, an anti-blowout sub, a safety bypass sub, a memory sensor package, a release joint, or combinations thereof.

4. The BHA of claim 1, wherein the foaming chemical selected from the group consisting of a gas, a surfactant, oil, water, and combinations thereof to form the foam.

5. The BHA of claim 1, wherein the swab assembly is configured to swab the production tubing after the foam is formed.

6. The system of claim 1, wherein the foam assembly is configured to promote the formation of the foam downhole when the BHA is placed in fluid, and wherein the foam is configured to lift a target volume of a static fluid that occupies the product tubing.

7. A system for initiating natural flow in a well, the system comprising:

a bottom hole assembly (BHA) disposed in a production tubing of the well, the BHA comprising:

a rope socket coupled to a foam assembly, the foam assembly comprising:

the foaming assembly is configured to release a foaming chemical to form a foam;

at least one chemical canister; and a check valve unit coupled to the at least one chemical canister, wherein the check valve unit comprises a plurality of foam nozzles; and a swab assembly coupled to the foam assembly, wherein the swab assembly comprises a swab mandrel and a plurality of swab cups; wherein the at least one chemical canister comprises a second chemical canister coupled between a first chemical canister and the swab assembly;

wherein the BHA is configured to displace a workover fluid and reduce hydrostatic pressure in the production tubing with a combined generation of the foam from the foam assembly and well swabbing with the swab assembly; and a slickline unit coupled to the rope socket of the BHA.

8. The system of claim 7, wherein the BHA further comprises one or more selected from a spang jar, a stem weight bar, an anti-blowout sub, a safety bypass sub, a memory sensor package, a release joint, or combinations thereof.

9. The system of claim 7, wherein the foaming chemical selected from the group consisting of a gas, a surfactant, oil, water, and combinations thereof to form the foam.

10. The system of claim 7, wherein the foam assembly is configured to release the foaming chemical in an amount sufficient to form a column of foam in the production tubing, wherein the column of foam has a length from a target depth to a wellhead and flowline.

11. The system of claim 7, wherein the swab assembly is configured to swab the production tubing after the foam is formed.

12. The system of claim 7, wherein the foam is capable of producing a lift effect to reduce tension on the slickline cable.

13. A method for initiating natural flow in a well, the method comprising:

conveying a bottom hole assembly (BHA) on a slickline to a first depth into a production tubing, wherein the production tubing comprises a static fluid, the BHA comprising:

a foam assembly comprising a check valve unit coupled to a chemical canister, wherein the check valve unit comprises a plurality of nozzles; and a swab assembly coupled after the foam assembly, wherein the swab assembly comprises a swab mandrel and a plurality of swab cups, holding the BHA stationary in the static fluid;

releasing a foaming chemical from the chemical canister to the production tubing via the check valve unit;

activating the foaming chemical to form a foam;

opening a well flowline; and swabbing at least a portion of the production tubing with the swab assembly of the BHA by at least partially removing the BHA from the production tubing.

14. The method of claim 13, further comprising;

collecting data from one or more sensors of the BHA;

determining a second depth of the production tubing; and conveying the BHA to the second depth of the production tubing.

15. The method of claim 13, wherein swabbing at least a portion of the production tubing comprises swabbing the production tubing to a surface of the well to retrieve the BHA at the surface.

16. The method of claim 15, further comprising:

closing the well; and monitoring the well to determine if the well is naturally flowing.

17. The method of claim 16, further comprising:

if the well is not naturally flowing, opening pressure control equipment disposed at a wellhead of the well;

accessing the BHA;

downloading, by a computer, data from a memory sensor package;

adjusting a plan for an additional run in the production tubing with the BHA based on the data;

reloading a foaming chemical in the chemical canister of the BHA;

reloading the BHA in the pressure control equipment of the wellhead;

and repeating the method for initiating natural flow in a well.

18. The method of claim 16, further comprising:

if the well is naturally flowing, initiating production processes for the well.

* * * * *